United States Patent [19]

Webster

[11] 4,152,997

[45] May 8, 1979

[54] CLOSING OF CONTAINERS

[75] Inventor: George Webster, Shipley, England

[73] Assignee: Metal Box Limited, Reading, England

[21] Appl. No.: 859,751

[22] Filed: Dec. 12, 1977

[30] Foreign Application Priority Data

Dec. 15, 1976 [GB] United Kingdom ..... 52367/76

[51] Int. Cl.[2] ..... B21D 19/00

[52] U.S. Cl. ..... 113/24 R; 113/29

[58] Field of Search ..... 113/7 R, 28, 29, 30, 113/24; 72/41–44, 236

[56] References Cited

U.S. PATENT DOCUMENTS

| | | | |
|---|---|---|---|
| 1,789,856 | 1/1931 | Balbitt et al. | 113/24 X |
| 2,397,979 | 4/1946 | Peterson | 113/24 |
| 2,563,496 | 8/1951 | Schmidt | 113/29 X |
| 2,993,457 | 7/1961 | Geeson et al. | 113/24 R |

*Primary Examiner*—Leon Gilden

*Attorney, Agent, or Firm*—Tilton, Fallon, Lungmus & Chestnut

[57] ABSTRACT

The disclosure relates to can end seamers and similar apparatus, in which end closures are secured on top of successive containers by securing tools, these tools and the support means which carry the containers being rotated simultaneously by a drive common to all the working parts of the machine and derived from a level above the securing tools. A single, unpressurized, gravity/centrifugal, entirely internal lubricating system is described.

8 Claims, 12 Drawing Figures

15
34
31
14
57
56
54
53
58
55
69
60
61
59
120
12
13
50
52
71
18
50
IV
38
124
128
24
IV
1
2
42
20
23
80
109
110
36
106
16
92
51
37
108
105
107
17
103
101
142
90
117
104
105
G4
G3
10
G18
26
G1
G2
118
130
43

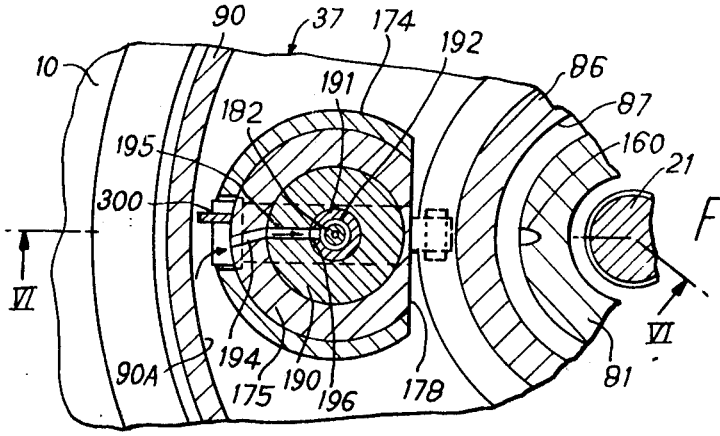
FIG. 7
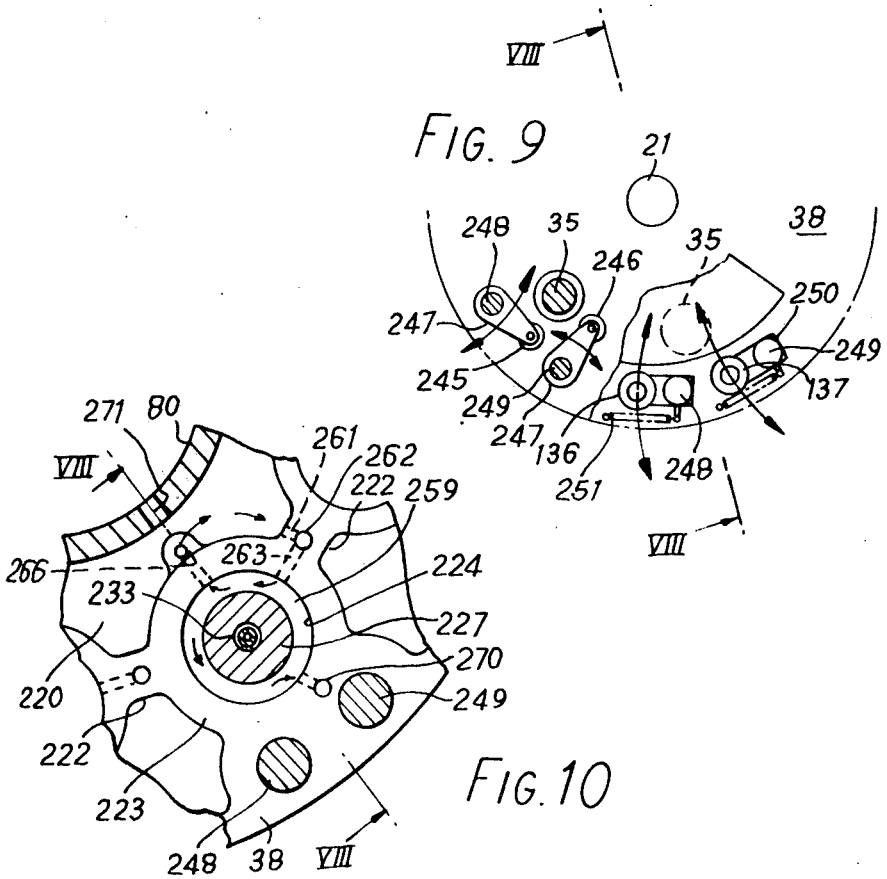
FIG. 9
FIG. 10

CLOSING OF CONTAINERS

This invention relates to apparatus for applying end closure members to a succession of container bodies said apparatus including container-body support means, and closure securing means above said support means, and drive means for driving at least said support means and securing means in simultaneous rotation about a common vertical axis, said drive means comprising a power source and transmission means arranged to transmit drive from the power source downwardly from above the said securing means to the driven working elements of the apparatus. Such apparatus will be referred to herein as "apparatus of the kind hereinbefore specified".

A typical embodiment of such apparatus takes the form of a seaming apparatus (or seamer) for seaming to a metal can body an end closure member. Seamers are used in two common applications: firstly by manufacturers of metal cans of the built-up or three-piece kind, to secure to one of the two open ends of a cylindrical can body the end closure member which will form the bottom of the can, and secondly, in canneries, by the canner who fills cans with products such as food, beer, or beverages. In cannery applications, the can body may be of the built-up kind already having its bottom attached to it, or it may be of unitary construction formed by drawing and related tequniques. In either case, the canner first fills the can body with product and then closes it by securing an end closure member to the open top of the filled can.

References herein to a container body or can body are to be understood to mean a body which includes or does not include its bottom, according to the context.

Seamers and similar apparatus of the kind hereinbefore specified present a number of problems in practice, particularly in canncery applications. The first of these problems relates to lubrication. A typical can seamer currently in use has a fixed base in which a lift table (constituting the container-body support means) is rotatably mounted. The lift table, as is standard practice in can seaming apparatus, includes a plurality of vertically-disposed can lifters, arranged with their axes on a pitch circle concentric with the lift table itself. Each can lifter is rotatable about its own axis and is also independently movable axially, to raise a can body into engagement with a seaming head above it. In addition, the seamer includes a seaming head turret (constituting the end closure seaming means), which includes a plurality of seaming heads arranged on vertical axes on a similar pitch circle. Each seaming head is rotatable about its own axis and is also movable axially. Axial movement of the can lifters and seaming heads is achieved by the use of cams.

In this and other known or hitherto-proposed seamers, the number of surfaces requiring lubrication is considerable and their nature diverse. These surfaces include the cam faces and co-operating cam follower surfaces; various journal bearings; and various rolling bearings.

In addition, it has hitherto been common practice to derive the motion of the various moving parts from a motor or other drive means in the base of the apparatus; and this has necessitated the provision of telescopic shafts for driving certain components of the apparatus whose vertical position depends on the height of the container body. Thus, in addition to the various surfaces requiring lubrication and mentioned above, there are also sliding surfaces for this purpose in addition to the sliding surfaces required for achieving axial movement of the can lifters.

It will be appreciated that the lubrication requirements of some surfaces differ greatly from those of others, as to frequency of lubrication and quantity of lubricant required. Nevertheless, it has been standard practice in the past to provide pressure lubrication systems of the manually-operated, "one-shot" type, in which bearings and other surfaces requiring lubrication are, individually so far is practicable, supplied with grease through pipes, valves and other components of the system. Such a lubrication system is super-imposed on the machine and in practice, has to be fitted externally. Because of the large number of lubrication points necessary to achieve many different grease paths all radiating from a single source or from a small number of sources, a pressure-type one-shot grease lubricating system is extremely complicated and therefore expensive to provide. Furthermore, because it is arranged externally of the apparatus, it is difficult to protect the pipes and other components of the system from mechanical damage and from corrosion (to which reference will be made later herein). In practice it is found that a "one-shot" system of this kind is subject to frequent failures.

It is also difficult in practice to provide a common superimposed lubrication system for the lift table and other components carried by the base of the apparatus, on the one hand, and, on the other hand, for the seaming heads and other components arranged above the level of the containers being closed. In addition, one aspect of different requirements for lubrication mentioned above is that lubricant may be forced out of bearings which run at higher speeds unless the pressure at which lubricant is supplied is sufficiently high. In practice it is difficult to ensure that a single superimposed grease lubrication system of the "one-shot" pressure type will supply lubricant to each lubrication point at the most suitable pressure where this pressure differs—as it does in apparatus of the kind under consideration—widely as between some bearings and others. Similarly, design limitations are imposed in practice on the range of quantity of lubricant applied in each operation by a one-shot system of this kind to different lubrication points having widely different requirements.

Thus the designer is faced with a choice between over-lubrication at some points, or under-lubrication at others, even if all points require lubrication at the same time interval. However, in practice the widely-different kinds of bearings etc. do not all need lubrication at the same time intervals, and the danger of under-lubrication necessitates lubrication at intervals of time no greater than the maximum safe period during which the bearings or other lubrication points most in danger of under-lubrication can be allowed to run. In effect, therefore, some other lubrication points will inevitably be over-lubricated.

It is in any case disadvantageous that, in order to operate a "one-shot" lubrication system of the kind discussed above, the apparatus must be stopped in order to permit grease to be applied under pressure by the system. Frequent stops of this kind, typically twice per shift or one every four hours, result in serious loss of production. Furthermore, the time during which the apparatus is stopped may have to be sufficient to operate not only the grease lubrication system, but also to allow any other surfaces to be lubricated which, for one reason or another (such as the limitations discussed above on the applicability of this system to widely-different kinds of lubrication points) require to be attended to separately. As an example it may be mentioned that in one modern type of seamer currently in use, there are besides the superimposed one-shot, pressure-type grease lubricating system for many of the bearings, thirty exposed grease nipples on the base of the machine.

A second serious problem arising in known apparatus of the kind hereinbefore specified is that of cleanliness. The likelihood of over-lubrication at some points in the apparatus gives rise to excess lubricant findings its way into parts of the machine where it may be deleterious, or on to the outside, from which it must be removed. This necessitates an undesirable high frequency of maintenance which, in the case of internal maintenance at least, necessitates again stopping the apparatus. Furthermore, the lubrication system itself requires frequent maintenance.

The intricate arrangement of pipes, valves, grease nipples and other components, required for the lubrication of the apparatuses discussed above makes external cleaning difficult and protracted. This again results in loss of production, especially since, under current safety regulations, guards must be provided which prevent access to the machine itself whilst it is running. In practice, cleaning is often likely to be performed in a less than perfect manner, with oil, grease or other contaminants gradually being allowed to accumulate among the various parts on the outside of the machine.

One source of contamination consists in the lubricant for the seaming heads, which are of course directly over the container bodies on the lift table. Lubricant finding its way, by gravity or otherwise, downwards, may tend to drop into the container. It is therefore desirable to provide a means for lubricating the seaming heads in such a way that at least the bulk of the lubricant is removed otherwise than downwardly.

The various problems discussed in the foregoing are particularly serious in cannery applications of a seamer, and all the more so when the product being packed is perishable. This is partly because loss of production time can result in deterioration of the product, and partly because the difficulty of cleaning the machine can have serious consequences to the product. This is of course most marked when the product is a food or beverage, where not only will any contamination lead to spoilage of the product, but hygiene regulations also have to be satisfied. This applies to direct contamination by lubricant or other dirt finding its way from the seamer into the product itself; it also applies to indirect contamination, for example aerobic contamination by fungal spores grown in crevices among the external parts of the lubricating system.

A further problem that has arisen in cannery applications arises from the fact that it is usual to couple the seaming apparatus to a filling machine. Can bodies are filled, by the latter, with the product and then closed by the seamer, the filling machine being driven by the seamer through a device typically known as an "in-motion" timer to synchronise the operation of the two machines. It has been found that unduly high rates of wear tend to occur in the filler drives of some known seamers, and in particular in the gearing and bearings of the drive itself and of the in-motion timer. This is thought to be at least partly due to faulty lubrication.

Yet another problem, particularly in cannery applications, is that of contamination of the apparatus itself by food, beverages or other products spilt or splashed accidentally from filled containers before the latter are closed. Occasional spillage or splashing is to be expected sooner or later in the operation of any filling or closing apparatus, and its effects can be highly deleterious. Apart from the obvious undesirable effects of decomposing food on the outside of the machine, some products, and particularly certain carbonated beverages having a high acid content, are known to be highly corrosive. Considering external contamination of the apparatus by spillage of such a beverage, for example, a "one-shot" superimposed lubrication system of the kind discussed above typically comprises copper piping with brass nuts and other components made of steel. The exposed parts of the apparatus itself are mainly of cast iron and steel. It is easy for split liquids to set up electrolytic corrosion in these circumstances, with consequent failure of the lubrication system, and other damage, unless the machine is stopped and thoroughly cleaned. Furthermore, corrosive products tend to affect the working of the lubrication system valves, and so eventually lead to lubrication failure.

Similar corrosion, particularly in the vicinity of bronze bearing bushes or elsewhere in the presence of dissimilar metals, will tend to occur inside the machine if spilt product is allowed to enter. In addition, any kind of product entering the machine will tend to cause eventual damage to bearings, and consequently an important function, of whatever lubricating system is provided, is to purge the bearings. In this connection it is pointed out that many products consist largely of water.

For this and other reasons, some of which have been explained in the foregoing, it is essential that a suitable lubrication routine be carefully followed. Because this involves frequent stopping of the machine, with consequent loss of production, it is difficult for a canner to supervise his operatives sufficiently well to ensure that the routine is properly carried out. This will be the case particularly where unskilled labour is involved, and/or where the operatives are paid at piece-work rates and may wish to wait until the end of a shift before stopping the machine. In addition, because food and other products deteriorate, it is desirable to fill and close the cans as quickly as possible so that they can be processed by heating, so that undue stoppage of the seamer can, in extreme cases, cause actual wastage of significant quantities of product.

To a certain extent, contamination of the machine by spillage or splashing of the product can be reduced by placing the power source well away from the path of the container bodies, and by situating as much as possible of the drive means above the level of the container bodies. To this end it has already been proposed to arrange the power source above this level and to transmit the drive downwardly to the various moving parts of the apparatus. This arrangement has the further advantage of eliminating the need for a multiplicity of telescopic drive shafts, mentioned earlier herein. It also enables the base to be made smaller, thus reducing the area of external surface of the latter that will require cleaning.

According to the invention, an apparatus of the kind hereinbefore specified includes a single lubricating system comprising oil inlet means for introducing lubricating oil into the interior of the apparatus in an upper region thereof, oil flow means adapted for permitting oil, once so introduced, to flow freely and generally by gravity to and then away from each working element of the apparatus requiring introduction of lubricant thereto, the oil flow means defining oil guiding elements adapted to urge oil centrifugally in the vicinity of some of said working elements, means for applying pressure to oil once introduced into the interior of the apparatus being absent, and said oil flow means being entirely internal of the apparatus.

Preferably the apparatus has a hollow, upstanding base and a hollow upper casing supported from and above said base, said container-body support means and end closure securing means being respectively carried by said base and said upper casing and being respectively rotatable with respect thereto.

The external surface of at least the base is preferably substantially free of abrupt discontinuities whereby spillage of any substance thereon may be readily removed and whereby accumulation of dirt can be prevented. Furtheremore, the apparatus will typically have, in various parts thereof, pairs of opposed or co-operating surfaces terminating externally of the apparatus in upwardly or laterally facing directions. Preferably, such apparatus includes external shielding extending downwardly over each said termination whereby to prevent ingress of contaminants downwardly or laterally between the surfaces of each said pair.

Oil flow downwardly in the internal closed-circuit lubricating system is, as mentioned above, generally effected by gravity. In order, however, to introduce oil to bearing and other surfaces which are radially offset from the path of the oil upstream of such surfaces in the circuit, the apparatus includes oil passages so disposed and orientated in and/or with respect to appropriate rotatable and fixed parts of the apparatus, as to induce centrifugal flow of the oil to and over the said surfaces, such that said flow takes place under conditions such that it can return where required, in a direction having a radially-inward component, under the influence of its own pressure. In apparatus consisting of a can seamer, according to the invention, for example, this feature is preferably provided in association with the seamer heads, so that the bearings and sliding surfaces of the seamer heads are so lubricated that the oil is removed radially therefrom; any residual oil escaping downwardly is then easily contained by providing a suitable seal near the lower end of each seaming head, thus preventing escape of oil as a contaminant to food or other product in a container being closed.

The single lubrication system may be of a continuously-operable, closed circuit kind, or of an intermittently-operable, open circuit kind. In the former case, the system includes a sump, said oil inlet means comprising duct means connecting the sump with said upper region of the apparatus, and an oil pump in said duct means whereby said system is adapted for continuous operation. Where the single lubricating system is an open-circuit system, said oil inlet means comprises an intermittently-operable lubricator disposed above the level of said end closure securing means, and duct means connecting said lubricator with said upper region of the apparatus.

Since oil flow is continuous so long as the pump is operating, the closed-circuit system displays the advantages, well known in continuous oil lubrication systems, of providing continuous scavening, together with the facility (achieved by appropriate design of the oil passages) for metering, to each pair of co-operating surfaces requiring lubrication, the mass flow of oil which is most suitable to those surfaces, without the need for valves with their attendant disadvantages already mentioned.

Preferably the various components of the drive means are so disposed as to permit the oil, as it flows downwards through the upper casing, to lubricate drive components therein by a simple cascade, thereby obviating the need for individual oil passages to these components. These drive components preferably comprise an auxiliary gear system, driving certain auxiliary working parts of the apparatus, carried by the upper casing. The cams controlling axial movement of the seaming heads and radial movement of the seaming rolls (where the apparatus is a seamer) are preferably fixed within the upper casing and similarly lubricated by cascade, as are main gears of the drive means, these gears being arranged to drive the container-support means, feed means and other working parts.

Apart from ensuring that the sump oil is kept at the required level, occasionally changing the oil and oil filter, and servicing the pump at appropriate intervals, an internal closed-circuit lubrication system provided in apparatus according to the invention normally requires no maintenance. It is not necessary normally to stop such apparatus more than once a day, or at the end of each shift if desired.

The same applies to an open-circuit lubrication system of apparatus according to the invention, because being unpressurised, such a system may be operated at any time whilst the apparatus is running. The lubricator in such a system may be of any known type, operable simply by depressing a lever to effect metering of the required quantity of oil to the upper region of the apparatus.

Absence of external lubricating pipes, valves and other components enables the exterior of the base and of the upper casing to be made smooth and easy to clean. Because the lubricating system is internal, the number of openings through the base and upper casing is drastically reduced, and the number of paths through which water, food or other contaminants can reach vulnerable parts of the apparatus is reduced to those few which can be readily protected by the provision of shielding as mentioned hereinbefore. This in turn permits the apparatus to be washed down with water, to which end an automatic or manually-operated integral washdown system may be incorporated in the apparatus. A further advantage of the plain and simple external surfaces, combined with appropriate shielding, made possible by the invention, is that when spillages or splashing of contaminants do occur, they will in the main be harmless, and can in any case be very quickly cleaned off with the minimum of delay to production.

Where a power take-off facility (such as a filler drive in a seamer) is provided, this can advantageously be situated in the hollow base of the apparatus and can be readily lubricated by the closed-circuit or open-circuit lubricating system. In particular, gearing for driving the power take-off and deriving motion from the main gears of the drive means, can be lubricated by simple cascade.

Apparatus according to the invention, because of its inherently simple, unpressurised lubricating system, elimination of telescoping rotating shafts, and other features, can be made at a reduced capital cost compared with commonly-used known types of apparatus of comparable power. Because of the reduction in stoppage time for cleaning and routine lubrication, or for repairs due to failures in the lubrication system, however, the output of containers in a given time is in fact increased, whilst maintenance costs are at the same time reduced. The number of components specifically concerned with lubrication is drastically reduced; in particular the number of moving parts is much reduced; valves, nipples, and various other components are eliminated. The number of spare parts that need be stocked is therefore also much reduced.

Two embodiments of apparatus according to or incorporating features of the invention, in the form of a can seamer for closing filled metal cans, will now be described, by way of example only, with reference to the accompanying drawings, all of which, except FIG. 1, are to some extent simplified in the interests of clarity, and in which:

FIG. 7 is a scrap sectional plan view taken on the line VII—VII in FIG. 6;

FIG. 9 is a diagrammatic scrap sectional plan view taken on the plane IX—IX in FIG. 8;

FIG. 10 is an enlarged scrap sectional plan view taken on the plane X—X in FIG. 8;

GENERAL DESCRIPTION

Figure 1:
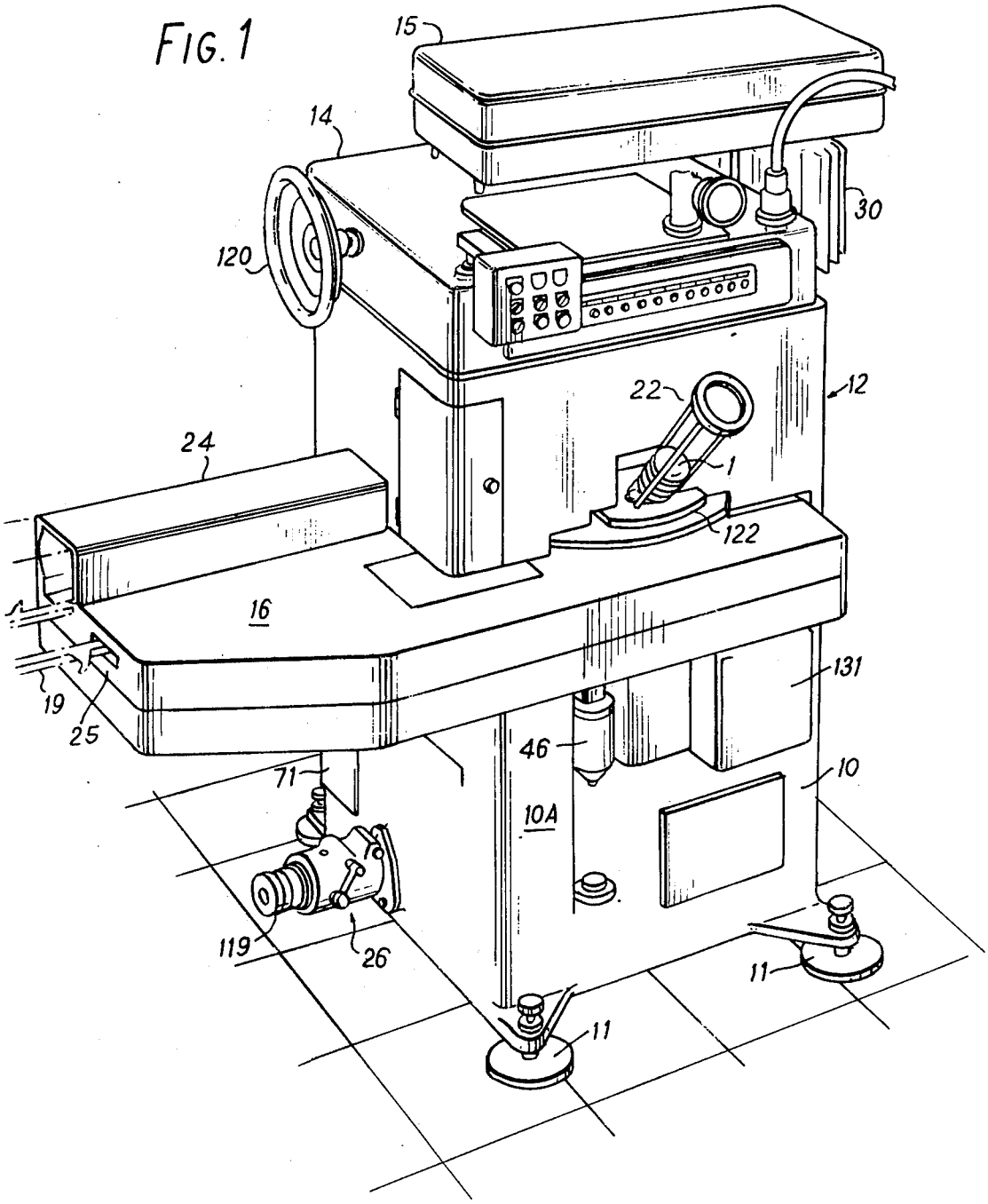
FIG. 1 is an external perspective view of the can seamer applicable to both of said embodiments.
Figure 2:
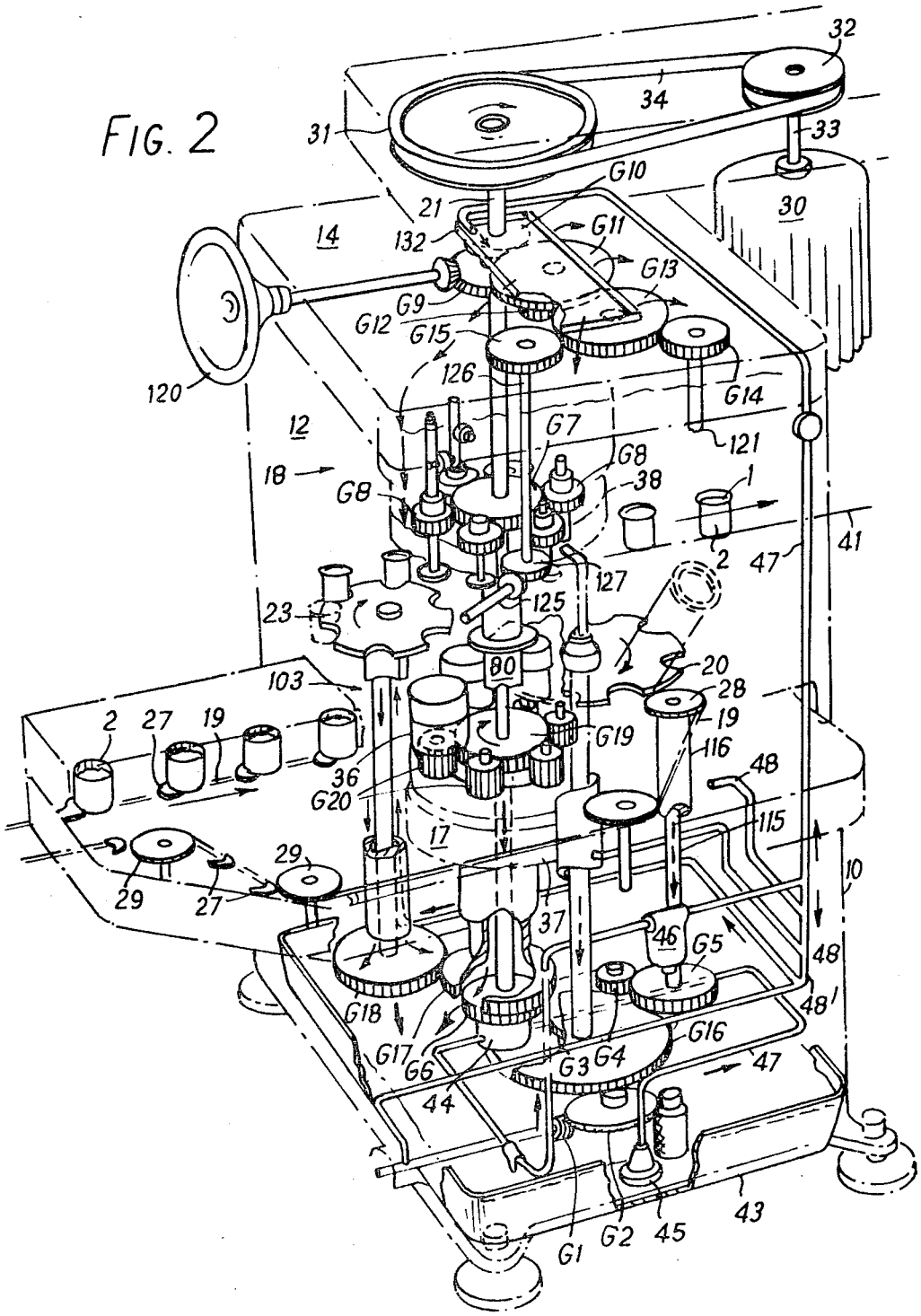
FIG. 2 is a cut-away view corresponding to FIG. 1, illustrating principal working parts of the seamer in the first of said embodiments, together with its drive means and part of the lubricating system.

Referring first to FIGS. 1 and 2, the can seamer shown therein is adapted for applying end closure members or covers 1 to a succession of container bodies in the form of open-topped cylindrical can bodies 2 filled with a product, which may be any product such as can be sold in cans but which for the sake of this description will be considered to be cat food.

The seamer comprises a hollow, upstanding case-iron base or pedestal 10, mounted on adjustable feet 11, and a machine head 12, including a hollow upper casing 13, supported from the base 10 in a manner to be described hereinafter, and situated above it.

The upper casing 13 includes an upper or auxiliary gearbox 14 and a belt drive casing 15 mounted on top of the upper gearbox 14.

The base 10 carries a fixed, hollow infeed conveyor table 16.

The seamer includes container-body support means in the form of a lift table assembly 17, carried by, and rotatable in, the base or pedestal 10; end closure securing means in the form of a seaming turret assembly 18, arranged above the table assembly 17 and being part of the machine head 12, the seaming turret assembly 18 being carried by, and rotatable in, the upper casing 13; container-body feed means in the form of an endless infeed chain conveyor 19 and a feed turret 20; and drive means for driving the lift table assembly 17 and seaming turret assembly 18 in continuous rotation about a main shaft 21 defining a common vertical axis of the lift table and turret assemblies 17 and 18.

The lift table assembly 17 includes a generally cylindrical lift table 37, whilst the seaming head turret assembly 18 includes a seaming head turret 38.

The drive means as will be seen hereinafter, also drives the feed conveyor 19 and feed turret 20 in synchronised relationship with each other and with the lift table assembly 17 and seaming turret assembly 18. The seamer also includes end closure feed means in the form of a cover feed device (not shown in FIGS. 1 and 2), a magazine 22 for holding a stack of the end closure members 1, and the feed turret 20. The latter is thus a part of both the body feed means and the closure feed means. The aforementioned cover feed device transfers end closures from the stack in the magazine 22 to the feed turret 20, and is driven by the drive means in synchronised relationship with the feed turret 20.

The feed turret 20 is carried by the base 10, as is a discharge turret 23, both turrets 20, 23 being rotatable about their own axes. The infeed conveyor 19 extends through the infeed conveyor table 16, the latter incorporating an enclosed tunnel 24 through which filled can bodies 2 are conveyed into the seamer. This tunnel, and the outer end face 25 of the infeed conveyor table 16, are arranged to abut similar parts of a can filling machine (not shown) which fills the can bodies 2 and is driven, in synchornism with the seamer, through a power take-off unit 26 of the seamer.

The infeed chain conveyor 19, which is of any suitable kind, having equally-spaced, can-body engaging dogs 27, is arranged to extend over sprockets in the filling machine, but is driven by the seamer drive means, by means of a drive sprocket 28, and extends over idler sprockets 29.

The drive means includes a power source in the form of a vertically-mounted electric motor 30, incorporating a brake and coupled by transmission means with movable working parts of the seamer in a manner to be described hereinafter, such that the drive is transmitted thereby from the motor 30 downwardly from a pulley 31 carried by the main shaft 21 and situated above the seaming head turret assembly 18. The seamer is thus an example of an overhead drive apparatus as hereinbefore defined. The said transmission means includes, in the belt drive casing 15, a variable pitch pulley 32 on the motor shaft 33, the latter extending upwardly from the motor 30 itself; the pulley 31, which is driven from the pulley 32 by a vee-belt 34; the vertical main shaft 21; various gears carried by the main shaft 21; further gears driven directly or indirectly by the gears on the main shaft; and shafts or other components to which at least some of the said further gears are fixed.

The gearing is situated essentially in four groups or systems spaced vertically from each other. These systems are as follows, reading downwards in FIG. 2. Near the top of the main shaft 21 is an auxiliary gear system G9 to G15, arranged in the upper or auxiliary gearbox 14, above the seaming head turret 38, for driving the aforementioned cover feed device and a can marker (not shown in FIGS. 1 and 2) which can be utilised to mark indicia, such as a batch number or date, automatically on each can end closure member in known manner. The second gear system consists of a seaming head drive gear G7 which drives simultaneously six seaming head pinions G8, each of which is mounted on a respective one of six seaming heads 35. The six seaming heads are equally spaced on a common pitch circle of the seaming head turret 38, in which they are simultaneously rotatable by the gear G7, each about its own axis.

Figure 5:
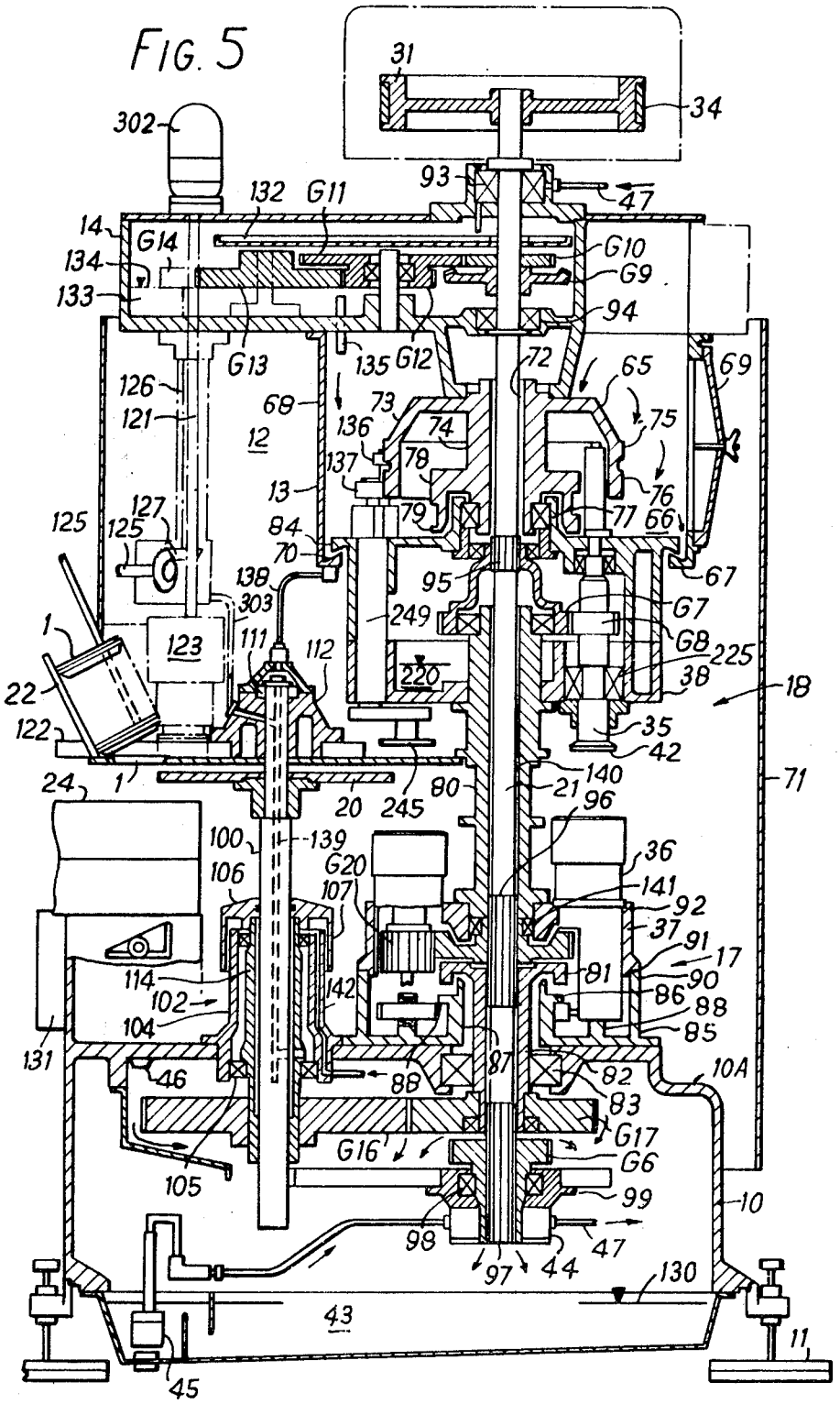
FIG. 5 is a part-sectional elevation taken substantially on the diametral plane indicated at V—V in FIGS. 4, 7, 9 and 10, but showing the lift table rotated through 30° from the position shown in FIG. 3.

The third gear system is shown in FIG. 5 but not in FIGS. 1 and 2, and is generally similar to the seaming head drive gear system G7, G8; it consists of a can lifter drive gear G19 carried on and rotatable by the main shaft 21 and engaging six can lifter gears G20. Each of the can lifter gears G20 is part of a respective one of six can lifters 36, which are equally spaced on a common pitch circle of the lift table 37, in which they are simultaneously rotatable by the gear G19, each about its own axis.

The fourth and main gear system is situated within the hollow base 10. It consists of a primary drive gear G6 carried by the main shaft 21 and rotatable thereby, a gear train G3 to G5, G16 to G18, and a pair of gears G1, G2. The gears G1, G2 drive the power take-off unit 26. As will be explained more fully hereinafter, the main gear system drives the feed turret 20, the infeed conveyor 19, and the discharge turret 23. The lift table 37 and seaming head turret 38 are rotated together by the main driven gear G17.

In operation, with the seamer drive motor 30 in continuous operation, the filling machine and the infeed conveyor 19 are thus driven in continuous motion by the motor 30, as are the various working parts of the seamer operated by the drive means. Thus the lift table 37 and seaming head turret 38 rotate about the axis of the main shaft 21 whilst the feed and discharge turrets 20 and 23 rotate in the appropriate directions, the seaming heads 35 and can lifters 36 being in rotation at the same time in the turret 38 and lift table 37 respectively, and the cover feed device and can marker also being driven continuously.

The filled can bodies 2 are transferred by the feed turret 20 on to the can lifters 36, and at the same time an end closure member 1, previously transferred to the feed turret 20 by the cover feed device from the magazine 22, is placed loosely by the feed turret upon each can body 2. These operations take place at the pick-up station indicated at 39 in FIG. 4. Further rotation of the lift table 37 and seaming head turret 38 brings each can in turn to a seaming station indicated at 40, FIG. 4, at which the cover 1 is seamed by formation of a conventional peripheral double seam, to the can body 2; after which the completed can is transferred by the discharge turret from the can lifter 36 to a discharge conveyor which is not itself shown in the drawings. The location of the discharge conveyor is however indicated at 41 in FIGS. 2 and 4.

The actual seaming operation is conventional; as each can lifter 36 approaches the seaming station 40 it is raised by a lifter cam so as to bring the can cover 1, carried by the filled can body 2 on the can lifter, into engagement with a seaming chuck 42 of the seaming head 35 above it. Thereupon a first-operation seaming roller, followed by a second-operation seaming roller deform the edge of the cover to form the double seam, after which the can lifter is lowered to release the can from the seaming chuck before it reaches the discharge turret 23. One first-operation seaming roller and one second-operation seaming roller are provided in association with each seaming head 35. The seaming rollers, not shown in FIG. 2, are carried by the seaming head turret 38 and are operated by fixed cams, to be described hereinafter.

The seamer has a continuously-operable, single lubrication system, disposed substantially entirely internally of the seamer. The lubrication system is arranged in a closed circuit, and includes a main sump 43 in the hollow base or pedestal 10, and a main pump 44 driven by the main shaft 21 in continuous rotation. The pump 44 draws lubricating oil from the main sump 43 through a strainer 45, and pumps the oil through a filter 46 and main oil feed line 47, to an upper region of the seamer, namely the upper gearbox 14. The oil is caused to flow from there, mainly by gravity to and over bearing and other surfaces of the seamer requiring lubrication, i.e., those internal surfaces which are arranged for movement relative to, and in contact with, other internal surfaces.

In this example, the majority of such surfaces are lubricated by oil initially pumped to the upper gearbox 14, this oil flowing generally downwards through the seamer until it returns to the main sump 43. The remainder of the said surfaces comprise bearings associated with the discharge turret 23, infeed conveyor drive sprocket 28, and feed turret 20. These bearings are continuously fed again mainly by gravity, with oil supplied by the pump 44 through branches 48 of the main oil feed line 47.

As can be seen from FIG. 1 and others of the Figures, the external surfaces of the base 10 and upper casing 13 are substantially free of abrupt discontinuities and substantially free of fittings, the main exceptions to the latter being the power take-off unit 26 and a control panel 49 (FIG. 1) which is mounted on the upper gearbox 14 well above and away from any danger of spillage or splashing by food from the can bodies 2.

The seamer will now be described in more detail.

LAYOUT AND CONSTRUCTION

Figure 3:
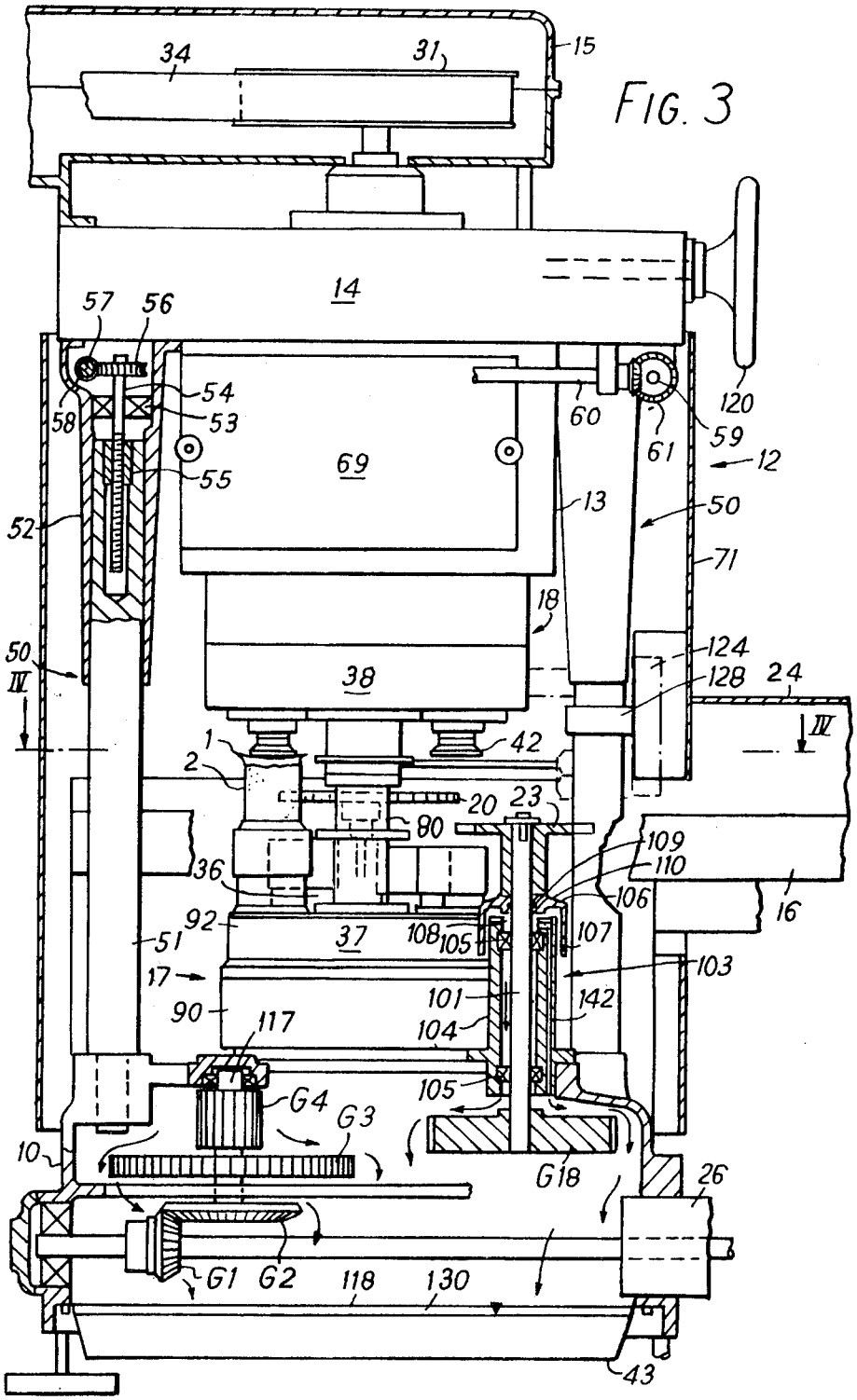
FIG. 3 is a part-sectional elevation of the same seamer as seen from the back in FIG. 2, i.e. in the direction indicated by the arrow III in the latter.

Referring now to FIGS. 2 to 5, it will be seen from FIG. 3 that the hollow base 10 is open at the bottom, the main sump 43 being a separate component accommodated in the open bottom of the base. The machine head 12 is supported upon the base 10 by three telescopic pillars 50, each comprising an upstanding column 51 carried by the base 10, and a hollow tubular column 52 depending from, and fixed to, the upper casing 13. Fixed in each hollow column 52 is a bearing 53 in which a vertical shaft 54 is rotatable. The shaft 54 is threaded and engages a threaded bush 55 in the corresponding column 51. Each shaft 54 carries a gear wheel 56 which engages a worm 57 on a shaft 58 or 59, the shafts 58 and 59 being coupled together by a cross-shaft 60 through bevel gears 61, and rotatable by means not shown to raise and lower the machine 12 so as to adjust the seamer to the exact setting required for seaming cans of a particular height. Because all components whose working position depends on can height are carried by the machine head 12, this is the only adjustment necessary for this purpose.

As is best seen in FIG. 5, the upper casing 13 comprises the upper gearbox 14 (with the belt drive casing 15 mounted on top of it as already mentioned); a seaming head turret support 65 fixed to the bottom of the upper gearbox; and a cam box 66, which is also fixed to the upper gearbox and depends therefrom. The cam box 66 has a bottom 67 having a circular opening, and comprises sidewalls 68, one of which incorporates a removable, oil-tight inspection cover 69; the sidewalls 68 form a continuous enclosure around the turret support 65, and an inwardly-directed gutter 70 is formed around the circular opening in the bottom of the cam box 66. The upper casing 13 carries a light, outer protective shield 71, which is removable, and which protects both the seamer and the exposed product in the cans from external dirt and contamination.

The turret support 65 is of generally-circular cross-section, and has a central core 74 formed with a coaxial bore 72, and a bell portion 73 from which the core 74 depends. The bell portion 73 has its outer periphery formed with two continuous fixed cams, namely an upper, or first-operation, seaming roller cam 75 and a lower, or second-operation, seaming roller cam 76. The lower end of the core 74 of the turret support carries a roller bearing 77 which is the upper main bearing on which the seaming head turret 38 rotates with respect to the upper casing 13. Spaced radially from the upper main bearing 77 is an encircling portion 78 of the turret support 65, having a fixed seaming head cam 79 formed around its outer periphery.

The seaming head turret 38, which is shown much simplified in FIG. 5 and which will be described in detail hereinafter, is supported partly by the upper main bearing 77 and partly by a coaxial coupling sleeve 80, which is fixed at its lower end to the lift table 37 and near its upper end to the turret 38. The lift table 37 (also to be described in more detail hereinafter) has a central core portion 81, having a downward extension 82 which is mounted in a roller bearing 83 which is the lower main bearing and which is mounted in the base 10 of the seamer. Thus the seaming head turret 38 and lift table 37 are rotatable as a single unit, supported entirely by the two main bearings 77 and 83. The downward extension 82 of the lift table core portion 81 has fixed to it the main driven gear G17.

It will be noted from FIG. 5 that the upper part of the seaming head turret 38 has a peripheral lip 84 which overlaps the gutter 70 of the cam box, to form therewith a rotary oil seal which, by centrifugal action when the turret is rotating, tends to throw oil radially outwards and downwards within the gutter.

The hollow base or pedestal 10 of the seamer has a smooth outer surface 10A and carries an upstanding, annular, lift table support 85. The latter has a core section 86 having a bore 87 extending upwardly and coaxially above the lower main bearing 83. This core section 86 has around its outer periphery a fixed cam lifter side cam 88. An upstanding annular, fixed thrust cam 89 is formed on the base of the lift table support 85. The function of the cams 88 and 89 will be apparent from the detailed description, later herein, of the lift table assembly, which in FIG. 5 is shown greatly simplified. The lift table support 85 has, finally, a peripheral annular outer wall 90 having around its upper edge a continuous dynamic grease and vapour seal 91 against which the lower edge of an outer wall 92 of the lift table 37 rotates.

The main shaft 21 extends vertically downwards from the pulley 31, through a main shaft thrust bearing 93 at the top of the upper gearbox 14; a secondary bearing 94 also carried by the upper gearbox; and thence coaxially through the bore 72 of the seaming head turret support, the seaming head turret 38, coupling sleeve 80 and lift table 37. The main shaft terminates in the hollow base 10. It has three splined sections, viz. an upper splined section 95 carrying the seaming head drive gear G7, an intermediate splined section 96 carrying the can lifter drive gear G19, and a lower splined section 97. The latter carries the primary drive gear G6, which rotates by means of a lower main shaft bearing 98 in a bearing housing 99 of the seamer base 10. The lower splined section 97 extends beyond the bearing housing 99 through, but not connected directly with, the impeller (not shown) of the main oil pump 44, which is shown diagrammatically in FIG. 5 and whose casing is fixed to the bottom of the bearing housing 99. The impeller is coupled to, and directly driven by, the main drive gear G6.

The feed turret 20 and discharge turret 23 are of the conventional disc type (FIG. 2), having nine and six equally-spaced peripheral pockets respectively. Each is mounted on a vertical shaft, 100, 101 respectively, rotatable in a pedestal 102, 103 respectively, fixed in the top of the seamer base 10. The pedestals 102 and 103 are of generally-similar construction, and therefore only the discharge turret pedestal 103 need be described. As is shown in FIG. 3, the pedestal 103 comprises a cylindrical outer casing 104 carrying in its bore a pair of axially-spaced rolling bearings 105. The top of the casing 104 is closed by a hood 106, which incorporates a depending skirt or shield 107 extending downwardly below the level of the upwardly-facing termination of the interface 108 between the cooperating parts of the upper bearing 105. The purpose of this shield is to prevent ingress of dirt, water, or food from the cans 2, into the bearings 105 and hence into the interior of the seamer. The hood 106 is provided with an internal O-ring seal 109 on the shaft 101, and has a sloping top surface 110 to minimise retention of dirt. The shafts 100 and 101 extend through the top of the respective hoods 106. However, whilst the discharge turret shaft 101 terminates at its upper end in the discharge turret 23 itself, the feed turret shaft 100 extends upwardly beyond the feed turret 20, its upper end being rotatable by means of a rolling bearing 111 in an enclosed bearing block 112 carried by the upper casing 13 and forming part of the machine head 12.

It will be seen that when the height of the machine head 12 is adjusted with respect to the base or pedestal 10, the main shaft 21 and feed turret shaft 100 are enabled by the splines on the former, and the keyed connection of the latter, to move up and down freely with the machine head.

The shaft 101 of the discharge turret 23 is mounted directly in the bearings 105 of the pedestal 103, and carries the gear G18 at its lower end to rotate the turret 23. The shaft 100 of the feed turret, on the other hand, as is shown in FIG. 5, is keyed at 113 to a sleeve 114 which is mounted in the bearings 105 of the pedestal 102. The gear G16 is fixed to the sleeve 114 to rotate the feed turret 20.

Each of the idler sprockets 29 of the infeed chain conveyor 19 is mounted in a simple, sealed bearing mounting (not shown) of any suitable kind. The drive sprocket 28 is mounted on a shaft 115 carried by a pedestal 116 (FIG. 2) shown diagrammatically but in fact generally similar to the discharge turret pedestal 103 and fixed to the seamer base 10. The drive sprocket shaft 115 has fixed to it the infeed conveyor drive gear G5.

The base 10 carries a vertical layshaft 117, FIG. 3, to which are fixed a pinion G4, a layshaft drive gear G3, and a bevel gear G2. As is best seen in FIG. 2, the operation of the main gear system is as follows. Rotation of the main shaft 21 drives the main or primary gear G6, which in turn engages the gear G3 to drive the layshaft 117. The pinion G4 on the latter engages both the infeed conveyor drive gear G5 and the feed turret drive gear G16. The gear G16 also, however, engages the main driven gear G17 which rotates the lift table and seaming head assembly. The discharge turret drive gear G18 is driven directly by the main driven gear G17.

The bevel gear G2 engages a second bevel gear G1 fixed to a horizontal power take-off shaft 118. The latter drives the power take-off unit 26 (FIGS. 1 and 2) which is not shown in detail but which comprises an in-motion timer and a coupling 119, FIG. 1, the timer and coupling being coupled together by a releasable overload clutch. The coupling 119 is arranged for a drive shaft of the filling machine to be secured to it.

The upper gear system, housed in the upper gearbox 14 (FIGS. 2 and 5) includes a primary drive gear G10 fixed to the main shaft 21 and driving a pinion G12 through a gear G11. The pinion G12 drives, through a further gear G13, a cover feed device drive gear G14 and a marker drive gear G15. Also fixed to the main shaft 21 is a bevel gear G9, driven by a disengageable hand-wheel 120, which is used, when required, to turn the seamer over manually.

Figure 4:
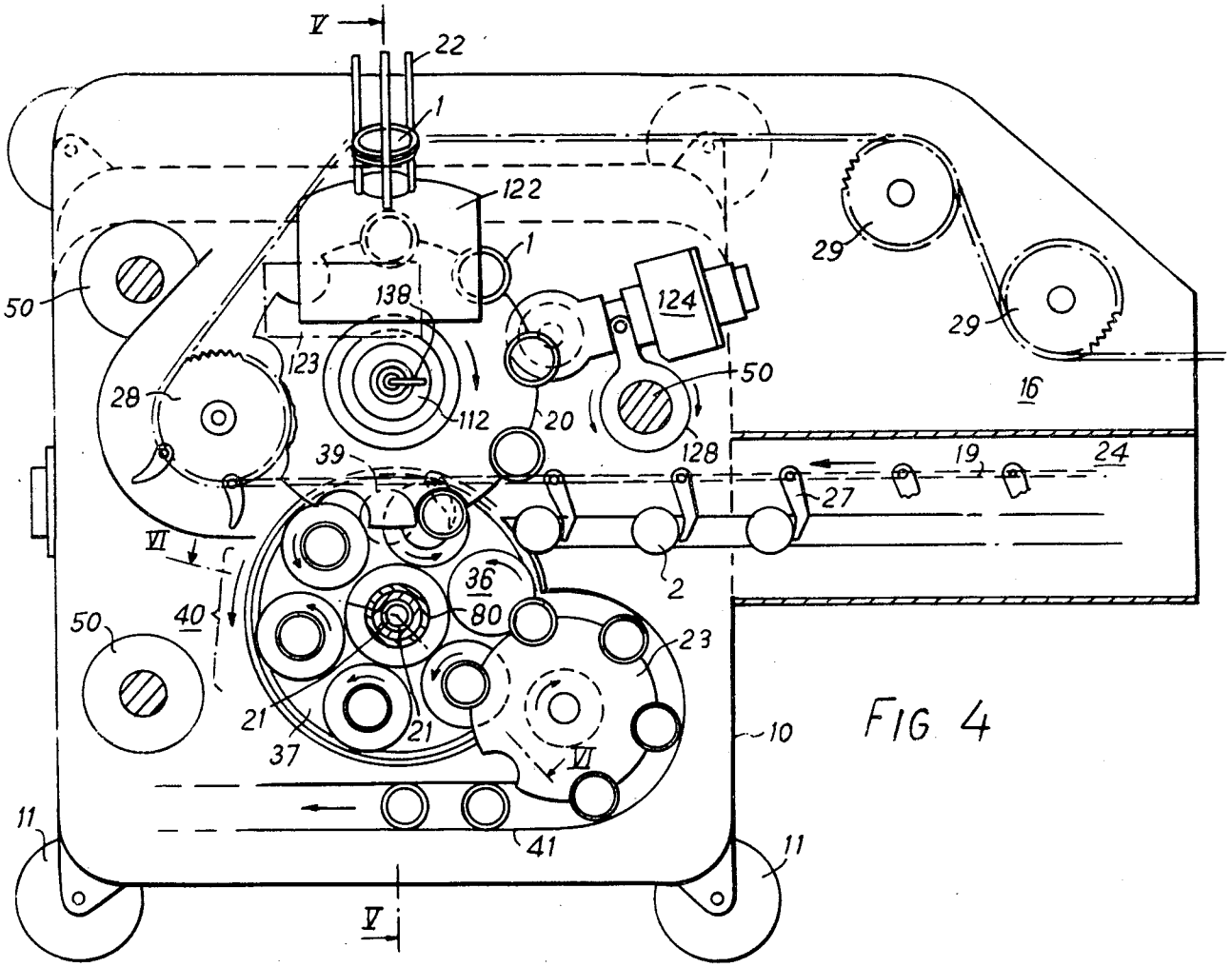
FIG. 4 is a partly-diagrammatic sectional plan view taken on the plane IV—IV in FIG. 3, but showing a lift table of the seamer in a different rotational position from those in which it is seen in FIGS. 3 and 5.

The cover feed device, which is driven by the gear G14 through a vertical shaft 121 which also drives a tachogenerator 302, is associated with a baseplate 122 in the seamer head (FIG. 4) and is indicated diagrammatically at 123 in FIGS. 4 and 5. The device 123 is in this example of the single-screw type arranged, in known manner, to remove can end members 1 from their stack in the inclined magazine 22, and to place them on a rotating turret. In this case, this rotating turret is the nine-position feed turret 20 itself.

The can marker unit, shown diagrammatically at 124 in FIGS. 3 and 4, has drive means comprising a horizontal drive shaft 125, FIG. 2, driven by the gear G15 through a vertical shaft 126 and bevel gears 127. The marker unit 124 comprises a drive means and a marker, of any suitable kind, coupled to the marker drive means.

The marker unit 124 is mounted on a bracket 128, the latter being carried by one of the main columns 51 and rotatable about the latter, so that the marker can be swung out of the way when required.

Referring now to FIGS. 2, 3 and 5, the layout and operation of the internal lubricating system, the broad principle of which has already been explained above, will now been described in greater detail. The normal level of oil in the main sump 43 is indicated at 130. The inlet of the main pump 44 is connected to the strainer 45 immersed in the oil in the sump, and its outlet is connected by the main feed line 47, through the filter 46, to an oil distributor 131, from which oil is passed into the various lines 47, 48 etc., shown diagrammatically in FIG. 2. The main feed line 47 terminates at its upper end in the top main shaft bearing 93, through which oil passes to fall into a pan 132. The pan 132 is arranged in the upper gearbox 14, overlying the gears therein, and oil pumped through the main bearing 23 spills continuously over the edges of the pan 132 to lubricate the gears G9 to G15, and their bearings. This oil replenishes an oil bath 133 defined by the upper gearbox itself, the normal level of this oil bath being indicated at 134 in FIG. 5. Oil drains continuously, by gravity, from the oil bath 133, partly through a drain 135 into the cam box 66; partly through the drive means of the marker unit 124, and thence through a pipe 303 (FIG. 5) into the seamer base via the bearing block 112 and feed turret shaft 100; and partly through the intermediate main bearing 94 to the top of the seaming head turret support 65. In the cam box 66, the oil lubricates the seaming roll cams 75, 76 and their associated cam followers, 136, 137 respectively. Some of this oil drains into the gutter 70, and some is carried round to lubricate the seaming head cam 79 and associated parts of the seaming heads 35 extending above the seaming head turret 38. The oil in the gutter 70 drains therefrom, through a pipe 138, into the bearing block 112, to lubricate the feed turret shaft upper bearing 111. The feed turret shaft 100 has a central bore 139, through which this oil, with that from the pipe 303, is drained from the upper bearing 111 into the main sump 43 via a radial port in the shaft 100 and thereafter the lower bearing 105.

Oil that has passed through the intermediate bearing 94 enters the seaming head turret 38 to lubricate moving parts carried by the latter in a manner to be described in the section of this specification headed "Seaming Head Turret". At this point it is important to note that there is radial clearance around the main shaft 21, defining an annular space 140 (see FIG. 5) except where the splined sections 95 to 97 of the shaft engage corresponding splines of the gears G7, G19, G6. This annular space 140 constitutes an important passage for downward flow of oil, which also, incidentally, lubricates the splined sections themselves. Thus oil that has entered, and subsequently lubricated, the seaming head turret assembly 18, leaves the latter by spilling, as will be seen, into the annular passage 140 within the coupling sleeve 80, whence some of it enters the lift table assembly 17 to top up the lubrication sub-system of the latter, in a manner to be described in the section headed "Lift Table Assembly". As will be seen, however, most of the oil, after leaving the seaming head turret, lubricates the bearing 141 of the drive gear G19 and falls thence, partly down the annular passage 140 and so out over the main drive gear G6 to lubricate the latter and the bearing 98 below it, and partly through the lower main bearing 83. Oil leaving the bearing 83 spills over the main driven gear G17, to lubricate the latter before falling into the main sump 43.

The movable parts of the feed turret pedestal 102 (FIG. 5), the discharge turret pedestal 103 (FIG. 3) and the infeed chain conveyor drive sprocket pedestal 116 (FIG. 2) are lubricated as follows. The cylindrical casing 104 of each of these pedestals has an oil infeed passage 142 formed longitudinally in the thickness of the casing wall. The lower end of this passage is connected to the appropriate one of the oil feed branches 48 (FIG. 2), and the upper end is open to the bore of the casing above the upper bearing 105. Thus, oil pumped through the appropriate branch 48 flows generally downwardly through the bearings 105, and thence spills over the gear G5, G16 or G18 below the pedestal, to lubricate this gear before falling back into the main sump. In the feed turret pedestal 102, some of the oil passes between the sleeve 114 and shaft 100 to lubricate their keyed, co-operating sliding surfaces. The internal bearings, and other components requiring lubrication, in the power take-off unit 26, are lubricated by oil pumped through the branch 48', FIG. 2; whilst the gears G1 to G4 associated with the layshaft 117 are lubricated by spillage of oil from the gears G5, G16 and G17.

LIFT TABLE ASSEMBLY

Figure 6:
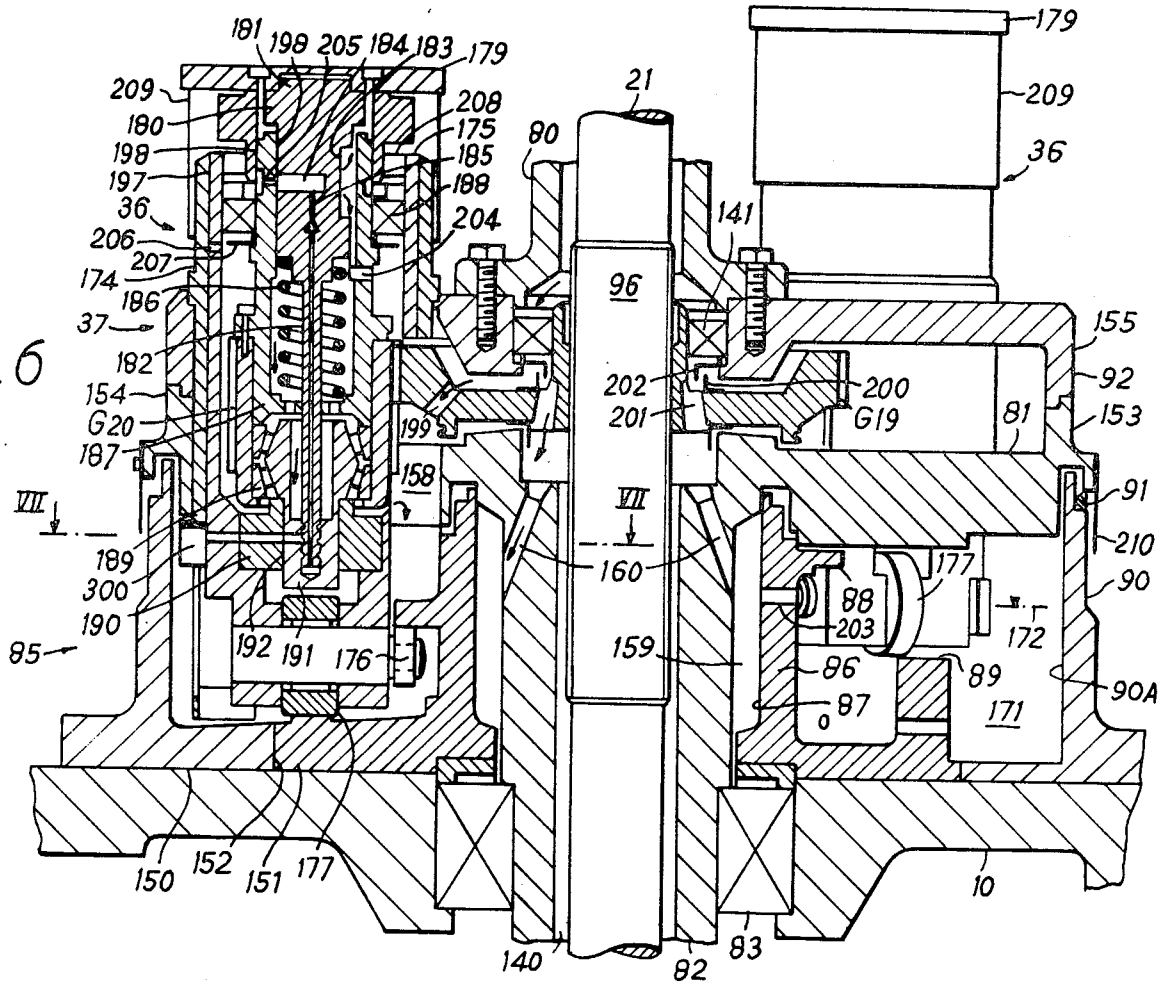
FIG. 6 is an enlarged part-sectional elevation, taken on the line VI—VI in FIG. 4 and showing details of the lift table assembly of the same seamer.

Referring now to FIG. 6, there are shown therein part of the top of the seamer base or pedestal 10; the lift table support 85 with its upstanding cylindrical core section 86 having the bore 87; the lift table 37; the fixed can lifter side cam 88; the annular fixed thrust cam 89; and the grease and vapour seal 91, all of which have already been mentioned with reference to FIG. 5. It will be seen from FIG. 6 that the lift table support 85 is in two parts, viz. an outer part 150, having the annular, upstanding, outer wall 90, and an inner part 151 sealingly abutting the outer part 150 at an annular interface 152. The thrust cam 89 is formed on the inner part 151, which latter also includes the core section 86.

It will have been noted that in FIGS. 3, 4 and 5, the lift table 37 is shown in three different rotational positions. The left-hand half of FIG. 6 is an enlarged view corresponding to the left-hand half of the lift table assembly as shown in FIG. 5.

The lift table 37, in the form shown in FIG. 6, consists of a lower part 153 comprising the central core portion 81 and an annular lower portion 154 of the lift table outer wall 90 (the latter being disposed circumferentially of, and integral with, the central core portion 81), and an upper part 155 which is fixed to and overlies the lower part 153, and which includes the upper portion of the outer wall 90. The coupling sleeve 80 joining the lift table to the seaming head turret, is fixed to the upper part 155 of the lift table. The core portion 81 is generally disc-like, and has six equally-spaced bores 158 to accommodate the respective can lifters 36. The upper part 155 carries the bearing 141 of the can lifter drive gear G19.

The previously-mentioned downward extension 82 of the central core portion 81 of the lift table depends integrally from the core portion, coaxially within the fixed core section 86 and spaced therefrom by an annular space 159 which extends down to the lower main bearing 83. The core portion 81 has downward oil passages 160 from the top of the core portion to the annular space 159.

Referring now to FIGS. 6 and 7, the core section 86 constitutes an inner wall of the fixed support 85 of the lift table. The top of the core section 86 carries a dynamic seal 166 engaging the underside of the core portion 81. The annular space between the outer wall 90 and the inner wall of the lift table support defines a lift table sump 171, the normal oil level of which is indicated at 172.

Each of the six can lifter bores 158 has a can lifter outer sleeve 174 fixed therein. The can lifter 36 itself comprises essentially a cylindrical outer body member 175 mounted telescopically in the outer sleeve 174, for vertical sliding movement therein, and a rotating assembly mounted in the outer body member 175. The lower end of the outer body member 175 carries a side cam follower roller 176 engaging the fixed can lifter side cam 88, and a thrust cam follower roller 177 engaging the fixed thrust cam 89. The fixed outer sleeve 174 and outer body member 175 are cut away in a chordal plane to form a flat face 178, FIG. 7, so as to clear the drive gear G19.

The rotating assembly of each can lifter 36 is constructed as follows. A flat, circular lift pad 179 is fixed to a can lifter core 180 having a head portion 181 and a depending coaxial, tubular pump spindle 182. The head portion 181 is shown severely simplified, for clarity; it has a number of longitudinal recesses 183 in its outer cylindrical face, alternating with lands having radial passages 184 which communicate with the bore 185 of the pump spindle 182. The core 180 is mounted coaxially, by means of a compression spring 186, on an inner body member 187. The latter is of generally-cylindrical, hollow construction, and has the pinion G20 of the can lifter, in the form of a ring, fixed coaxially around it. The inner body member 187 is, in turn, mounted in the outer body member 175 by means of an upper, low-friction bearing 188 and a lower bearing 189. The lower bearing 189 consists of a low-friction thrust bearing assembly, such as the pair of opposed taper roller bearings shown in FIG. 6, and is carried by a bearing mounting which is shown in simplified form. This bearing mounting comprises a bush 190 fixed coaxially in the outer body member 175, and a generally cylindrical inner sleeve 191 fitted in the bush 190. The inner sleeve 191 has a bore in which the lower end of the tubular spindle 182 fits rotatably. This lower end has a helical pumping channel 192, so that when the core 180 rotates with respect to the inner sleeve 191, the tubular spindle 182 of the former co-operates with the bore of the sleeve 191 to act as an oil pump, as will be seen hereinafter.

Intercommunicating, generally-radial ports 194, 195 and 196 are formed respectively in the outer body member 175, bush 190 and inner sleeve 191, to connect the space above the sump 171 with the bore of the inner sleeve in a position close to, and leading away from, the inner face 90A of the outer wall 90. A radial baffle 300 is fixed adjacent to the inlet of the port 194, to deflect into the latter oil thrown up the wall surface 90A by rotation of the lift table with respect to the outer wall 90.

In operation, as the main shaft 21 rotates, it rotates the whole lift table 37 about the axis of the main shaft, and also rotates the pinions G20 by means of the drive gear G19, as already described. Rotation of the lift table causes the cam follower roller 177, engaging the thrust or lift cam 89, to raise each can lifter 36 in turn. The cam 89 is so profiled that this raising operation begins at the rotational position of the lift table at which the filled can 2 is located over the lift pad 179 by the feed turret 20. The can thus becomes supported on the lift pad, and raises with it the corresponding cover 1 delivered by the feed turret. Immediately after the seaming operation, the side cam 88 engaging the cam follower roller 176, lowers the can lifter. Can lifters 36 are shown in the lowered and raised condition on the left-hand and right-hand sides of FIG. 6, respectively.

During raising and lowering of the can lifter, there is axial, relative sliding between the surfaces in the interface 197 between the fixed outer sleeve 174 and the outer body member 175. When the can lifter brings the can cover 1 into contact with the seaming chuck 42 (FIG. 3), the spring 186 is compressed slightly as the lift pad 179 and lifter core 180 are thereby arrested with further, final, upward movement of the remainder of the can lifter. During this final movement, there is slight axial relative sliding between the surfaces in the outer and inner interfaces 198, between the inner body member 187 and lifter core 180. The spring 186 applies axial thrust to the can and its cover during the seaming operation. In addition, throughout the operation of the seamer, the whole of the rotating assembly of each can lifter, viz. the lift pad 179 with the core 180 and inner body member 187, is in continuous rotation by virtue of the gear G19 and pinions G20, including rotating the can and its cover during the seaming operation.

It has already been noted that "top-up" oil for lubricating the lift table assembly is introduced through the annular space 140 between the main shaft 21 and coupling sleeve 80. Directions of some oil flows within the lift table assembly are indicated by arrows in FIGS. 6 and 7. The entire input from the annular space 140 passes through the bearing 141, whence it falls on to the gear G19. The latter propels a small part of this oil by centrifugal force outwards and through ports 199 in the gear G19 itself, and so downwards by gravity, through the can lifter bores 158 into the lift table sump 171. The remainder of the oil passes through a labyrinth formed by a pair of throttling baffles 200, through further ports 201 in the gear G19 and thence, via the passages 160 in the lift table core portion, to the lower main bearing 83.

One of the baffles 200 defines an annular throttle 202 between itself and the hub of the gear G19. It is only when this gear is rotating that some of the oil leaving the bearing 141 (all of which passes through this throttle) is forced upwardly between the two baffles 200 and so to the ports 199. When the gear G19 stops, all the oil falls through the ports 199, to be dumped in the main sump 43. The level of oil in the lift table sump 171 is normally regulated by provision of one or more ports 203 through the inner wall 86 of the lift table support, these ports acting as a weir.

The lift and side cams 89, 88 and their respective follower rollers 177, 176 are lubricated directly by oil in the lift table sump. The remaining components of the can lifters 36 are lubricated by oil lifted from the sump 171 to the upper part of each can lifter in two stages. The first stage is effected by oil being centrifugally raised, as mentioned above, to be deflected by the baffles 300 into the port 194, and so through the ports 195, 196 to the pumps 191, 182 in the can lifters. The second stage is effected by these pumps. The tubular pump spindle 182, rotating the bore of the inner sleeve 191 drives oil downwards to the bottom of the bore and pumps it up through its own bore 185 into the port 184 in the can lifter core head 181. By virtue of the rotation of the latter, the oil is forced radially outwards in this port 184, whence some of it lubricates part of the sliding interface 198 defined by the lands of the core head 181 and the bore of the inner body member 187. Some of this oil escapes downwards through the recesses 183 in the core head, and thence through a port 204 in the inner body member 187; into the space within the outer body member 175 below the upper bearing 188. Part of the remainder of the oil discharged from the port 184 is forced upwards by its own pressure, to lubricate the remainder of the interfaces 198; whilst the rest is propelled radially through a port 205 to the upper side of the upper bearing 188, which is gravity lubricated, as is the bearing 189. The sliding surfaces 197 are lubricated by oil thrown centrifugally outwards, through ports 206 in the outer body member 175, by a thrower ring 207.

Above the bearing 188, an annular oil seal 208 is provided between the core head 181 and the top end of the bore of the outer sleeve 174.

An important feature of the lift table assembly consists of a cylindrical shield 209, depending from each lift pad 179 and externally overlapping the outer sleeve 174, and a similar shield 210 carried by the lift table 37 and externally overlapping the outer wall 90 of the lift table support. The purpose of these shields 209, 210 is the same as that already described with respect to the shields 107 of the feed turret and discharge turret pedestals, viz. to prevent ingress of food spilt from the cans, dust, other dirt, and water.

SEAMING HEAD TURRET ASSEMBLY

Figure 8:
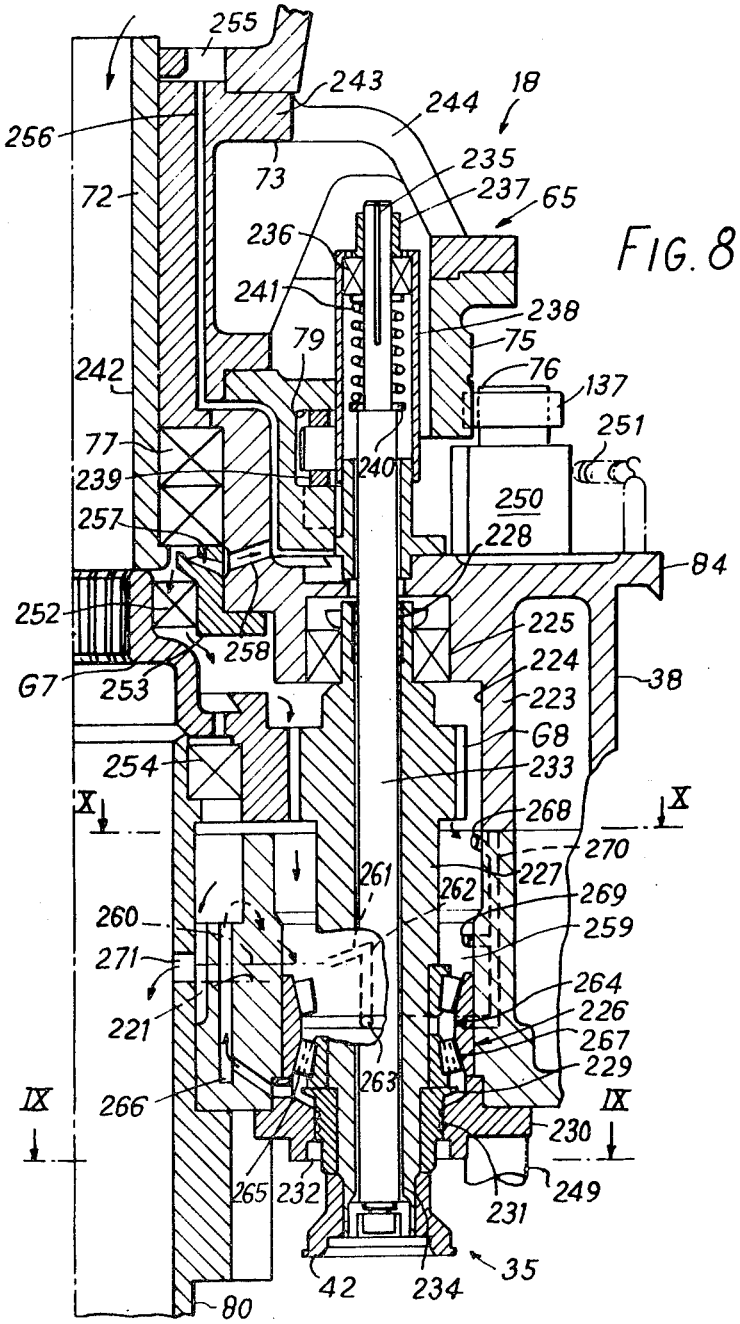
FIG. 8 is an enlarged sectional elevation corresponding to part of FIG. 5 and taken on the plane VIII—VIII in FIGS. 9 and 10, and shows one of six seaming heads of the same seamer.

Referring now to FIGS. 8 to 10 (in which the main shaft 21 is not shown) the seaming head turret 38 is partly hollow, defining a continuous, generally-annular internal oil circulating chamber 220 which constitutes an oil sump or reservoir, the normal oil level of which is indicated at 221 in FIG. 8. Surrounding the oil chamber 220 are internal walls 222, joined by six integral bosses 223, each of which has a seaming head bore 224 formed therein. The axes of the bores 224 are equally spaced on a common pitch circle. Each bore 224 carries an upper, low friction, seaming head bearing 225, and a lower seaming head bearing 226 which is of any suitable low-friction thrust type, for example the double taper-roller bearing shown in FIG. 8.

Each of the six seaming heads 35 is constructed as follows. A seaming head sleeve 227, which includes the gear G8 on its periphery, is mounted for rotation in the bearings 225 and 226. The sleeve 227 carries a sliding bearing 228 at the top end of its bore; and below the bearing 226 the sleeve carries a bush 229, which is mounted in and extends through, and is rotatable in, an end plate 230 closing the bottom end of the seaming head bore 224 of the turret. The bush 229 has a helical groove or grooves 231 on its outer cylindrical surface, and an annular dynamic oil seal 232 is provided between the bush 229 and end plate 230 at the bottom of the interface between them.

A seaming chuck 42, of conventional construction, is fixed to the bottom end of a chuck spindle 233 which extends through the bore of the seaming head sleeve 227, with an annular space 234 between the spindle 233 and sleeve 227. The chuck spindle 233 extends upwards therefrom, through the sliding bearing 228, and has at its upper end a key-way 235 to which is keyed an upper chuck spindle bearing 236 of the rolling type, slidable thereby axially along the spindle below a stop 237 fixed to the top end of the chuck spindle 233. The bearing 236 is carried by an actuating sleeve 238 surrounding the chuck spindle. The sleeve 238 carries a cam follower roller 239 which engages the seaming head cam 79. A lower stop ring 240 is fixed around the chuck spindle 233, and a compression spring 241 bears between the lower stop ring 240 and the inner ring of the bearing 236. The cam follower roller 239 is shown in FIG. 10 in its uppermost position, the lowest level of the cam 79 being indicated by broken lines. As the cam 79 forces the roller 239 downwards, the sleeve 238 pulls the bearing 236 downwards along the chuck spindle 233, so compressing the spring 241 to apply an axial downward force to the chuck 42 during the seaming operation.

The seaming head turret support 65, as shown in FIG. 8, comprises a central sleeve 242, carrying the upper main bearing 22 and having fixed around it a frame member 243 with openings 244 to permit oil to fall directly on to the seaming heads 35. The seaming head cam 79, and the seaming roller cams 75, 76, are carried by the frame member 243.

Associated with each seaming head 35 is one first operation seaming roller 245 and one second operation seaming roller 246. Each seaming roller (FIGS. 5 and 9) is conventionally carried by a seaming roller arm 247 fixed to the bottom end of a seaming roller spindle 248, 249 respectively. Each seaming roller spindle is journalled in a bore through the turret 38, its top end being fixed to a support block 250 which can pivot about the axis of the spindle 248 or 249, and which carries a seaming roller cam follower 136 or 137. The cam followers 136, 137, engaging the first and second operation seaming roller cams 75 and 76 respectively, cause swinging movement of the first and second operation seaming rollers 245 and 246 respectively. The turret 38 carries return springs 251 coupled with the support blocks 250 for operation in the usual way.

The drive gear G7 is mounted externally by means of a low-friction bearing 252 in a bush 253 secured in the seaming head turret 38, and internally by means of a second low-friction bearing 254 on the coupling sleeve 80.

Lubrication of the seaming heads 35, and other internal moving parts associated with the seaming head turret is effected as will now be described. It will have been realised from the last preceding section of this specification, that the lift table assembly 17 has what is, in effect, its own oil circulating system arranged in parallel with the main flow of oil, and receiving a small but continuous topping-up supply from the latter, whilst still being a part of the single internal lubricating system of the seamer. By contrast, the lubricating system of the seaming head turret 38 is effectively arranged in series with the remainder of the lubricating system of the seamer.

Oil that has passed through the intermediate bearing 94 (FIG. 5) collects in an annular gutter 255 formed on the top of the seaming head turret support 65, and falls thence through a passage 256 in the latter to lubricate the upper main bearing 77. Some of this oil then passes through the external drive gear bearing 252 and is urged centrifugally outwards by rotation of the drive gear G7 to lubricate the gears G7 and G8. The remainder of the oil from the main bearing 77 passes through substantially radial drain ports 257 in the bush 253, and thence, by centrifugal action due to the rotation of the seaming head turret, through ports 258 in the latter. Thence this oil falls downwards to lubricate the sliding bearing 228 and the seaming head bearing 225, after which it passes over the gear G8.

The annular space 259 between each seaming head sleeve 227 and the corresponding bore 224 of the turret is utilized as a swirl chamber, in which oil is urged round, as indicated in FIG. 10, by virtue of the high-speed rotation of the sleeve 227 itself combined with the slower rotation of the turret 38. The latter causes the sump oil level to rise to that indicated at 260 in FIG. 8, and oil from the sump 220 is centrifugally propelled at a high acceleration through an inclined port 261, through a vertical passage 262 and a port 263, into an annular channel 264 surrounding the thrust bearing 254. From this channel the oil is pumped by the bearing 254 itself into a collecting annulus 265 below the bearing and thence, at a relatively low acceleration, radially inwards and upwards via a passage 266, and so back into the sump 220. The helical grooves 231 of the bush 229 are so orientated as to tend to force oil upwards, thus reinforcing the pumping action of the bearing 254 to remove the oil through the passage 266. The rollers 267 of the bearing 254 are hollow to permit passage of the oil through them. In addition, the bearing 254 receives oil directly through the annular chamber 259 from the gear G8, whilst further oil from the gear G8 (via a port 268) and from the chamber 259 (via a further port 269) is passed to the channel 264 through a vertical channel 270.

It will be seen from the foregoing that the flow of oil to and through the lower bearing 254 of each seaming head is controlled in a manner such that, whilst generous lubrication can be provided, the oil is forced away from the seaming chuck 42 in a manner such as to prevent any leakage of oil out of the turret 38 and into the cans 2 being closed by the seamer.

Ports 271 in the coupling sleeve 80 provide a weir for regulating the static oil level in the seaming head turret sump 220, and an outlet for the oil leaving the turret assembly 18.

It will be understood that many variations are possible in the seamer above described. For example, the electric motor 30, with its belt drive 34, may be replaced by an hydraulic motor in known manner. The seamer may have any number of seaming heads, not necessarily six, with a corresponding number of can lifters. The principles embodied in the seamer may be incorporated in machines for filling and/or closing a succession of containers of any kind, particularly where high-speed operation is required.

Figure 11:
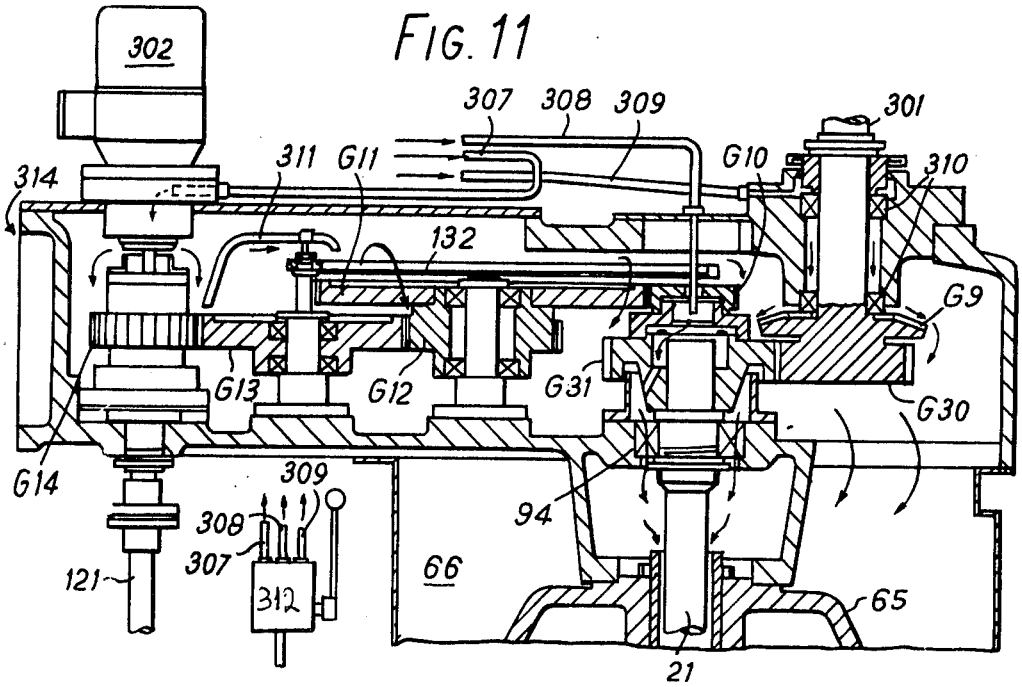
FIG. 11 is a sectional elevation showing an upper portion of the seaming head of a seamer in a second embodiment of the invention.
Figure 12:
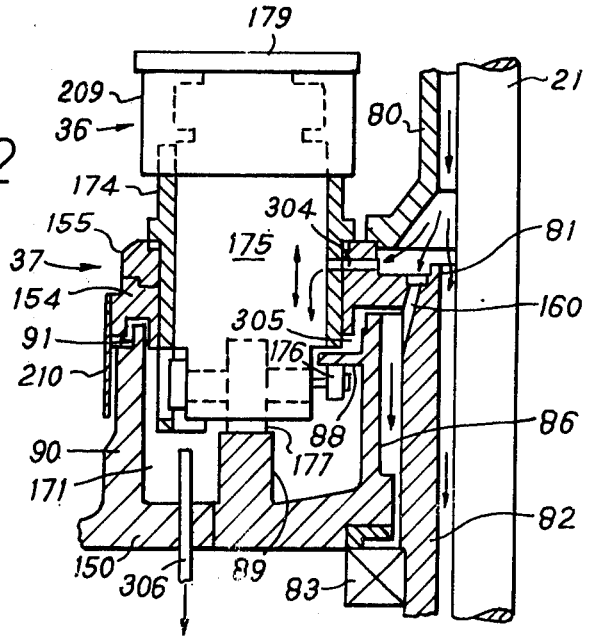
FIG. 12 is a scrap, part-sectional elevation showing part of a lift table assembly of the seamer of FIG. 11.

Referring now to FIGS. 11 and 12, these show parts of a second seamer, generally similar to the first embodiment above described but having a number of features differing therefrom. The main differences are that the seamer exemplified in FIGS. 11 and 12 is a four-head seamer, i.e., it has four can lifters and four corresponding seaming heads; and that it has a simpler lubrication system. The latter is again a single, internal lubricating system, but it is not continuously operable and is not arranged in a closed circuit.

The lubricating system of this second seamer is of the "one-shot" type, but is not pressurised, being effective (like the continuously operable, closed circuit system of the first embodiment) by virtue of a combination of gravity and centrifugal action. In place of the sealed sump 43, a simple loose drip tray may be provided in the un-pressurised one-shot system. The oil pump 44 and its associated pipes and filters are also absent from this second seamer.

Another difference is that a number of bearings of the second machine, which in the first embodiment are lubricated continuously by the closed circuit system, are not lubricated at all but are of the "sealed-for-life" kind. In particular, the bearings of the turrets mounted on the base, and the bearings wherein the lifters rotate with respect to the lift table, may be of this kind. As will be seen from the description which follows with respect to FIG. 12, this means that a substantially self-contained sub-system for lubrication of the lifters, in parallel with the main part of the lubricating system, is also absent.

A further simplification is that rotation of the can lifters, instead of being continuous in operation and effected by applied drive such as the gears G19, G20 as in the first embodiment, is intermittent, being derived from the rotation of the seamer heads when a can body and can end are in position between and in contact with the seaming chuck and the lift pad. The gears G19, G20 and the shaft splines 96 (FIG. 6) are therefore absent.

The upper gearbox 314 of the second seamer is shown in FIG. 11. The driven pulley of the belt drive from the main motor (not shown in FIG. 11) instead of being carried by the main shaft 21, is carried by a drive shaft 301 rotating in bearings 310 carried by the gearbox 314, and itself carrying a gear G30 which drives the main shaft 21 by means of a gear G31 carried by the latter. The other gears, and the oil pan 132, are substantially as described above in respect of the gearbox 14 of the first embodiment.

Oil is introduced into the seamer at predetermined intervals by a manually-operated, metering, distributor-type lubricator, (indicated diagrammatically at 312 in FIG. 11), via three pipes 307, 308, 309 to the upper gearbox 14. The lubricator is mounted on the seamer head above the level of the seaming chucks, and is supplied from an oil reservoir of any desired kind via a suitable pipe which is routed clear of those parts of the machine that are below the level of the seaming chucks.

The pipe 307 supplies oil to the top bearing of shaft 121 and the gear G14; rotation of the latter throws oil outwards to be caught and carried upwardly and outwardly by a duct 311 which feeds the oil pan 132. The pipe 308 supplies oil, as shown, to the main shaft upper bearing 94; whilst the pipe 309 supplies oil, as shown, to the drive shaft bearings 310 and gears G9, G30.

FIG. 12 shows, in part section, part of the lift table. Some of the oil passing down around the main shaft 21 from the upper gearbox 14 falls through the ports 160 to the lower main bearing 83 as before; some of the oil also, however, is diverted radially by centrifugal action through a radial passage 304, in the lift table core portion 81 and extending through the can lifter outer sleeve 174. This oil lubricates the sliding interface between the sleeve 174 and the outer body member 175 of the cam lifter 336. One passage 304 is of course provided for each of the four lifters 336. This oil falls to the lift table sump 171, but the latter receives its main supply of oil by centrifugal action forcing some of the oil from the ports 160 radially through a passage 305 above the fixed cam 88. In this embodiment the sump 171 partly drains, via a pipe 306, to lubricate certain of the gears in the lower gearbox, for example the layshaft gears G4, G3, G2 (see FIG. 3) and the gears engaged thereby.

It will be realised that in each can lifter 336, having sealed bearings in place of the bearings 188, 189 shown in FIG. 6, the pumping spindle 182 need not be provided, and that similarly all the oil passages provided in the lifter 36 of FIGS. 6 and 7 for the sole purpose of circulating oil to and from these bearings can also be absent.

I claim:

1. Apparatus for applying end closure members to a succession of container bodies, said apparatus comprising container body support means; end closure securing means above said support means; drive means for driving at least said support means and securing means in simultaneous rotation about a common vertical axis, said drive means comprising a power source and transmission means coupled to said power source whereby to transmit drive from said power source downwardly from above the end closure securing means to all driven working elements of the apparatus; and a single lubricating system comprising oil inlet means connected to an upper part of the apparatus for introducing lubricating oil into the interior of the apparatus in said upper part, oil flow means in and below said upper part for permitting oil, once so introduced, to flow freely and generally by gravity to and then away from each working element of the apparatus requiring introduction of lubricant thereto, the oil flow means further defining oil guiding elements adapted to urge oil centrifugally in the vicinity of some of said working elements, means for applying pressure to oil once introduced into the interior of the apparatus being absent, and said oil flow means being entirely internal of the apparatus.

2. Apparatus according to claim 1, having a hollow, upstanding base and a hollow upper casing supported from and above said base, said container-body support means and end closure securing means being respectively carried by said base and said upper casing and being respectively rotatable with respect thereto.

3. Apparatus according to claim 2, wherein the external surface of at least the base is substantially free of abrupt discontinuities whereby spillage of any substance thereon may be readily removed and whereby accumulation of dirt thereon can be prevented.

4. Apparatus according to claim 1, having pairs of opposed or co-operating surfaces terminating externally of the apparatus in upwardly or laterally facing directions, wherein the apparatus comprises external shielding extending downwardly over each said termination whereby to prevent ingress of contaminants downwardly or laterally between the surfaces of each said pair.

5. Apparatus according to claim 1, wherein the single lubricating system is a closed-circuit system comprising a sump, said oil inlet means comprising duct means connecting the sump with said upper part of the apparatus, and an oil pump in said duct means whereby said system is adapted for continuous operation.

6. Apparatus according to claim 1, wherein the single lubricating system is an intermittently-operable open-circuit system, said oil inlet means comprising an intermittently-operable lubricator disposed above the level of said end closure securing means, and duct means connecting said lubricator with said upper part of the apparatus.

7. Apparatus according to claim 1, comprising a can seamer wherein said container body support means comprises a lift table having a plurality of vertically reciprocable can lifters, said end closure securing means comprising a plurality of seaming heads, said transmission means being coupled to the seaming heads and to the lift table for effecting simultaneous rotation thereof.

8. Apparatus according to claim 7, including container body feed means for feeding the container bodies in succession to the said support means, the said transmission means being further coupled to said feed means for driving the feed means in synchronous relationship with said support means.

* * * * *